US005746481A

United States Patent [19]

Obermaier

[11] Patent Number: 5,746,481

[45] Date of Patent: May 5, 1998

[54] SITTING DEVICE

[75] Inventor: Anton Obermaier, Prien, Germany

[73] Assignee: Gebruder Obermaier oHG, Prien-Bachham, Germany

[21] Appl. No.: 786,433

[22] Filed: Jan. 21, 1997

[30] Foreign Application Priority Data

Feb. 2, 1996 [DE] Germany ..... 196 03 798.0
Apr. 3, 1996 [DE] Germany ..... 296 03 988.8

[51] Int. Cl.[6] ..... A47C 3/026

[52] U.S. Cl. ..... 297/452.41; 297/314; 297/325; 297/451.5; 248/599

[58] Field of Search ..... 297/313, 302.1, 297/314, 325, 452.41, 451.5; 472/134, 135; 108/90; 482/77; 248/562, 599

[56] References Cited

U.S. PATENT DOCUMENTS

| | | | |
|---|---|---|---|
| 186,570 | 1/1877 | Huttman | 248/599 |
| 3,235,221 | 2/1966 | Conner | 248/599 X |
| 3,309,137 | 3/1967 | Wiebe | 297/302.1 X |
| 4,438,919 | 3/1984 | Gamzo | 472/114 X |
| 5,044,587 | 9/1991 | Degen | 248/158 |

FOREIGN PATENT DOCUMENTS

| | | | |
|---|---|---|---|
| 26428 | 9/1972 | Australia . | |
| 1170615 | 1/1959 | France . | |
| 2 549 704 | 2/1985 | France . | |
| 71 09 479 | 3/1971 | Germany . | |
| 2029946 | 12/1971 | Germany | 482/77 |
| 73 618 | 3/1973 | Germany . | |
| 75 31 129 | 10/1975 | Germany . | |
| 94 00 040.9 | 8/1994 | Germany . | |
| 94 15 613 U | 2/1995 | Germany . | |
| 94 16 126.7 | 3/1995 | Germany . | |
| 295 04 326.1 | 7/1995 | Germany . | |
| 42 10 098 C2 | 10/1995 | Germany . | |
| 44 24 932 A1 | 1/1996 | Germany . | |
| WO 90/084900 | 8/1990 | WIPO . | |

*Primary Examiner*—Peter R. Brown
*Attorney, Agent, or Firm*—Anthony J. Casella; Gerald E. Hespos; Ludomir A. Budzyn

[57] ABSTRACT

The invention relates to a sitting device with a seating surface and a seat support supporting said sitting surface, the seat support being connected on the floor side with an elastically deformable support member for the tiltable mounting of the sitting surface.

7 Claims, 4 Drawing Sheets

SITTING DEVICE

BACKGROUND OF THE INVENTION

1. Field of the Invention

The present invention relates to the field of dynamic sitting and in particular to a dynamic sitting device based on tilted movements of the seat pad.

2. Description of the Prior Art

Seat pads are known which are developed in cushion shape (seat cushions). These seat pads are filled, for instance with an elastic resilient filler material, for instance with feathers, foam or the like. These known seat pads, however, result in a sitting position which is ergonomically incorrect and leads to continuous improper loading of the body. Cramps, strains or even permanent damage to health (for instance, curvature of the spine) may be caused thereby.

On the other hand, it is known that seat balls result in an ergonomically favorable sitting position in that the body is led to carry out continuous compensating movements (the so-called "dynamic seat"). By these compensating movements, damage to posture is avoided, since the muscular system is exercised by the compensating movements and the discs are subjected to load and released from load in rhythmic alternation, which is of importance for retaining the elasticity of the discs and thus the health of the user.

From Federal Republic of Germany 42 10 098 C2 (FIG. 1) a sitting device is known which has a deflectable base.

From Federal Republic of Germany 44 24 932 A1 and active-dynamic sitting device is known which has a substantially rigid, curved support surface.

German Utility Model DE-U 295 04 326 shows a device for relief upon standing which also has a curved bottom support surface. Furthermore, FIG. 6 of that utility model shows a curved cap 68, which can be understood as a curved support surface.

German Utility Model DE-U 94 15 613.1 already shows a chair which is movable on casters.

German Utility Model DE-U 75 31 129.4 shows a work seat having a spherical joint present at the lower end of the stand tube.

German Utility Model DE-U 73 111 40 shows a sitting device with ball bearing on top and on bottom as well as means for limiting the angle of tilt.

German Utility Model DE-U 71 09 479 shows an athletic device with single-point support, which to be sure is not clearly defined as a sitting device.

East German Patent DD-73 618 shows a pendulum seat of variable location having a convexly shaped foot, but without hollow cushions.

French 25 49 704 shows a swivel chair.

Finally, WO 90/08490 A1 shows an ergonomic seat with spherical base support.

SUMMARY OF THE INVENTION

The object of the present invention is to create a novel sitting device which, possibly with supplementation of the action of an optimally developed seat cushion, permits compensating movements upon sitting which were not heretofore obtainable in this manner and which make a particular possibility of exercising the spinal column and the pelvis possible.

In other words, the invention accordingly provides a limited labile tilted mounting of the sitting surface of the sitting device, for instance a chair or stool. In accordance with the invention, this tilted mounting is realized by an elastically deformable support member.

By the tilted mounting of the sitting surface proposed in accordance with the invention, in which the angle of tilt is preferably limited and adjustable, different compensating movements are obtained in the body of the person sitting thereon than can be obtained by traditional sitting balls, namely, in particular, compensating movements of greater deflection or amplitude, which also exercise the region of the pelvis.

Of particular advantage is the development of the bottom side of the support member as an air-filled hollow body or sitting cushion which is preferably fastened by a connecting bar to the sitting surface. The advantage of an elastically deformable support member developed in this manner is that it can be produced inexpensively and has a long life. If the sitting surface is furthermore also fixed by a seat cushion, the advantage of an optimal combination of the exercise movements obtainable therewith is also obtained.

Advantageously, a sitting surface is provided by an elastic body or an air-filled hollow body the resting region of which is connected to the seat support. By this embodiment of the sitting device of the invention, the specific compensating or exercise movements which can be obtained with a seat cushion are combined with the specific compensating or exercise movements which are obtainable only by the tiltable mounting of the invention.

A stool or chair can be obtained with the sitting device of the invention without great expense if the sitting surface and the support member are connected to each other by a preferably bar-shaped connecting element the length of which may be adjustable.

In the event that sitting surface and support member are arranged spaced from each other, means for limiting the tilt are preferably provided in order to keep the desired tilting dynamics of the chair which are obtained by the special tilt mounting within reasonable limits. Tilt-limiting means are preferably developed as elements protruding radially from the connecting bar, arranged at a predetermined distance above the elastically deformable support member, and preferably displaceable in the axial direction of the connecting element in order to be able to adapt the angle of tilt suitably to the existing conditions or the desires of the user.

On the basis of the sitting device of the invention with bar-shaped connecting element arranged between the sitting surface and support member there can readily be developed a chair in traditional shape such as, for instance, a chair with undercarriage in which the seat support is mounted in the undercarriage in the manner indicated above instead of resting directly on the floor. The sitting device is then mounted on casters or has a caster-mounted plate.

A restoring device or several restoring devices which urge the sitting device into a horizontal position are preferably arranged on the floor side in contact with the resting surface or the floor. The preferred, elastically developed restoring devices assure that the sitting device when it is not under load assumes a horizontal position of its sitting surface. In loaded condition the restoring devices are compressed so that a restoring force acting opposite the tilting deflection acts on the sitting device and brings it into the horizontal position. In the simplest case, the restoring force is proportional to the deflection and thus follows Hook's law. The restoring device can, for instance, be in the form of coil springs, an elastic hollow ring, or some other restoring device.

BRIEF DESCRIPTION OF THE DRAWINGS

Other objects, advantages and features of the present invention will become evident from the following illustrative description of a preferred embodiment, read with reference to the accompanying drawing, in which.

DETAILED DESCRIPTION OF THE PREFERRED EMBODIMENTS

Figure 1:
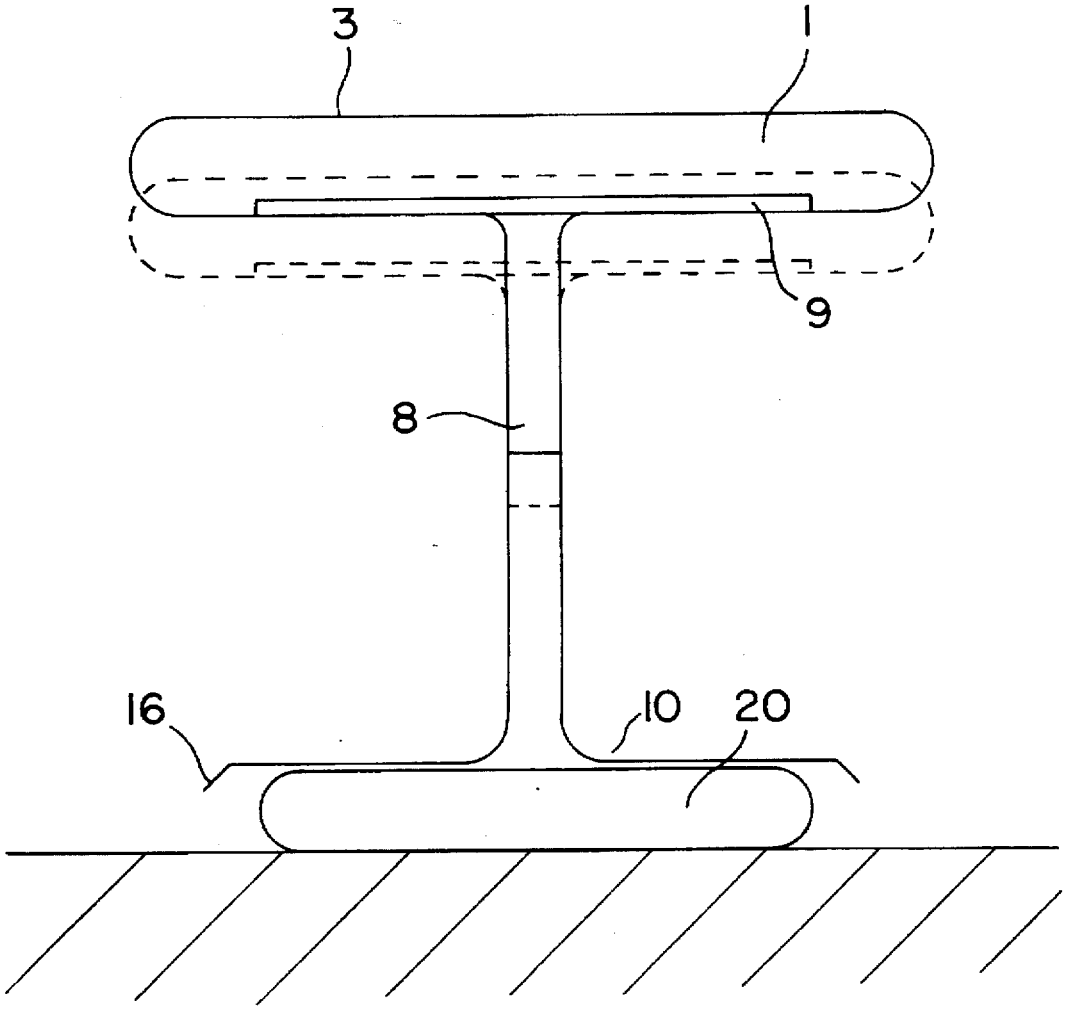
FIG. 1 shows a first embodiment of the sitting device of the invention with elastic support member.

The first embodiment of the sitting device of the invention shown in FIG. 1 consists of a seat cushion 1 which forms a sitting surface 3, and of a bar-shaped connecting element 8 which is connected at its lower end to an elastically deformable sitting body 20. The bar-shaped connecting element 8 serves as spacer element for the seat cushion and the support member 20. The sitting surface 3 of the seat cushion 1 and the lower surface of the elastically deformable support member 20 are coplanar in unloaded condition. The connection between the bar-shaped connecting element 8 and the support member 1 is developed as follows: On the upper end of the bar-shaped connecting element 8 there is fastened a disk 9, the disk 9 being attached to a bottom surface of the seat cushion 1. On the lower end of the connecting element 8 there is provided a disk 10 which is bonded to the support member 20. Although not shown, the lower end of the bar-shaped connecting element 8 can have a similar connection to the support member 20 as the upper end of the bar-shaped connecting element has with the seat cushion 1. The tubular connecting element 8 and the disk 9 preferably consist of metal, and the disk 9 is welded to the connecting element 8.

As shown in FIG. 1, the disk 9 on the seat-cushion side has a smaller diameter than the seat cushion and extends (not shown) by its circular edge into a corresponding circular undercut in the bottom surface of the seat cushion 1. This permits a simple and dependable mounting of the seat cushion on the disk 1 and possibly easy replacement of the seat cushion. The disk 10, on the other hand, has a larger diameter in the embodiment shown than the elastic support member 20. The edge of the disk 10 is bent in flange-like manner downward and forms a flange rim 16 serving as limitation of the angle of tilt. The flange edge 16 comes into contact with the floor already upon a moderate angle of tilt. The connection between the disk 10 and the support member 20, although it can in principle also be effected by an undercut, is formed in the present case by an adhesive attachment.

The sitting device shown in FIG. 1 represents a compact embodiment for promoting the dynamic sitting obtainable in accordance with the invention. In particular, in this dynamic sitting device, the known properties of a seat cushion in promoting dynamic seating are combined with a tiltable mounting of the support member which is produced by the elastically deformable support member. While the seat sitting cushion forms a labile sitting base which exercises the muscles of the back and pelvic region in the manner that movements of small deflection are produced, the elastic support member 20 promotes movements of the muscles of larger deflection. Finally, the combination of these exercise movements brought about by the seat cushion and the elastic support member and which makes possible, in particular, a rhythmic alternation of loading on the disks and relief of loading such as cannot be obtained up to now with seat cushions alone.

The embodiment of the sitting device of the invention shown in FIG. 1 can also be modified or simplified in the manner that the seat cushion is replaced by a soft or elastic covering. In this way, a dynamic sitting results which is based essentially on the tilting movement of the support member 20.

Figure 2:
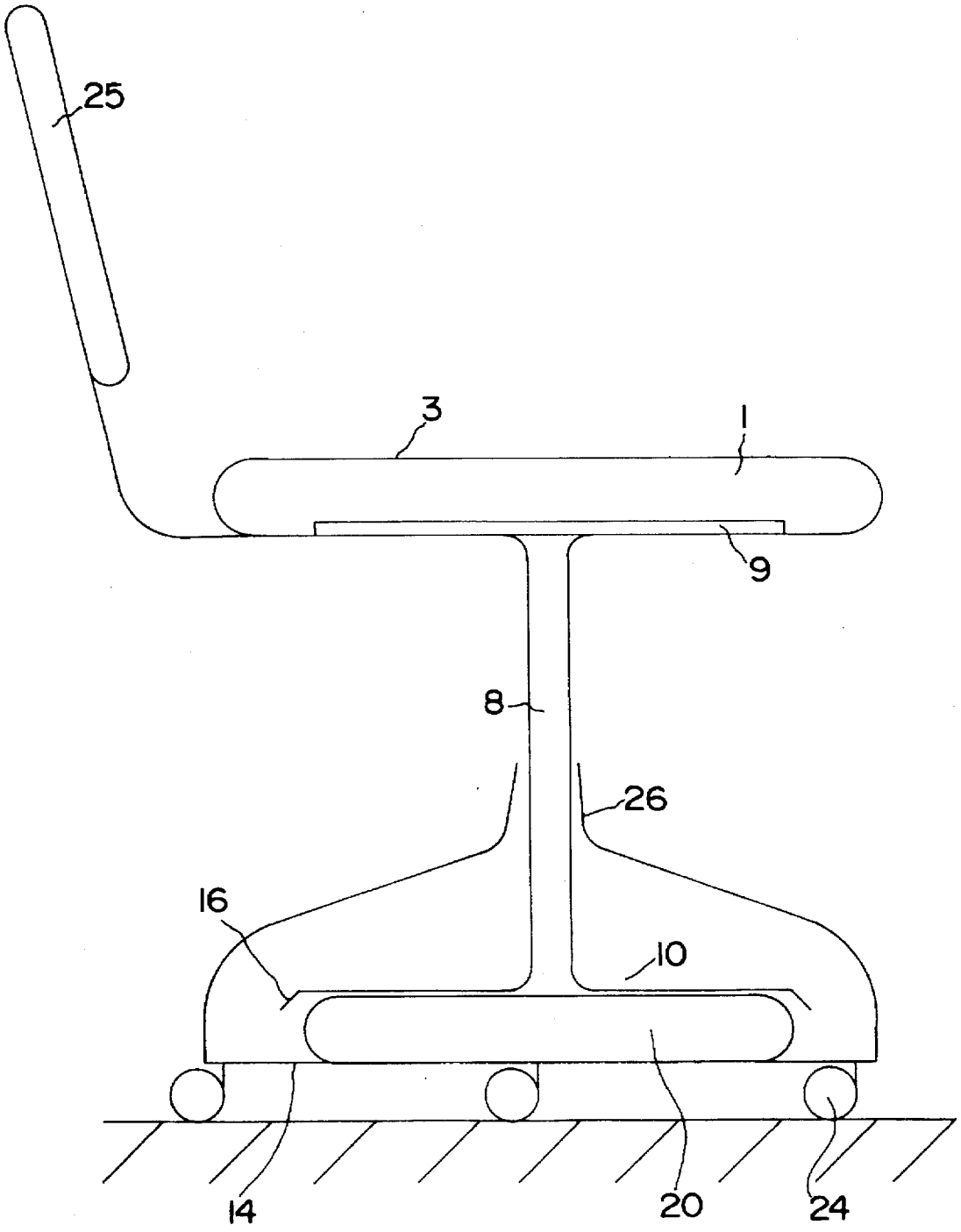
FIG. 2 shows a second embodiment of the sitting device of the invention, in which the support member, as a modification of the first embodiment, is so mounted in the chair undercarriage that the sitting surface can carry out a limited labile tilting movement.

The chair with back 22 shown in FIG. 2 includes the seat cushion 1 of the previous embodiment which is firmly attached by a bar 8 which extends downward from the bottom of the seat cushion 1. The chair shown furthermore comprises a chair undercarriage 10, shown diagrammatically, having five wheels 24, three of which are shown. The tilt limitation 16 shown in FIG. 2 is, for instance, of disk shape and is firmly attached above the support member 20 to the bar 8 and is possibly displaceable along the bar 8 in order to adjust the angle of tilt which is fixed by the edge of the tilt limitation 16 in cooperation with a corresponding abutment on the undercarriage 14. The seat cushion 20 is fastened to the disk 10, namely by bonding or, for instance, by an undercutting (not shown) of the seat cushion with disk 10 arranged therein, firmly attached to the bar 8. The seat cushion 20 rests on a flat support surface of the undercarriage 14 and the angle of tilt obtainable is determined by the tilt limitation 16, as explained above.

The cushion 20 serving as support member preferably differs in its dimensions from the seat cushion 1. While the seat cushion 1 forming the sitting surface typically has a height of about 7 cm, the cushion 20 forming the support member has a height of 2 to 8 cm, and preferably about 3.5 cm. The cushion 20 preferably has a larger diameter than the seat cushion 1. Furthermore, the elasticity of the two seat cushions can be selected different, in which case the cushion 20 serving as support member preferably is of less elasticity than the seat cushion 1 which fixes the sitting surface.

The embodiment of the sitting device of the invention shown in FIG. 2 is based on two seat cushions spaced from each other by a bar or foot can also be developed separately, i.e. without an undercarriage, in a similar manner to the embodiment of the sitting device of the invention shown in FIG. 1. Furthermore, this arrangement of two seat cushions 1, 20 can also be connected to each other by a (double) trumpet-shaped foot structure.

Figure 3:
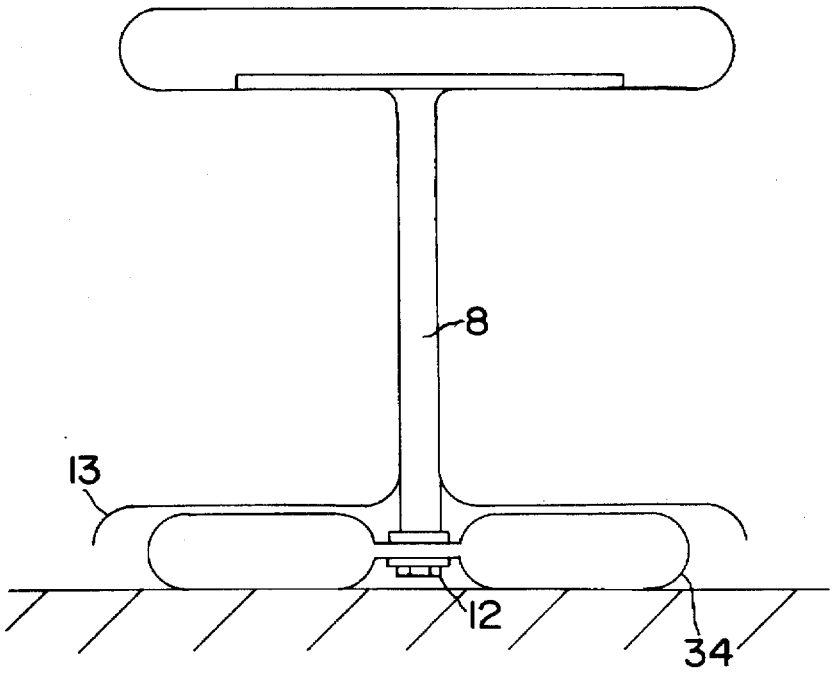
FIG. 3 shows another embodiment in cross section, in which an elastic air-filled hollow ring is provided as restoring device.
Figure 4:
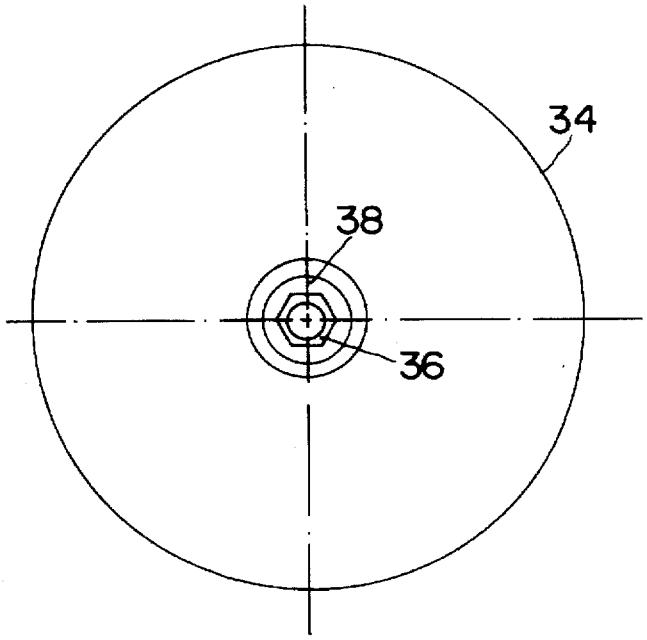
FIG. 4 is a view from the bottom of the embodiment of FIG. 3.

FIG. 3 shows another embodiment of a sitting device in accordance with the invention in which, instead of the cushion of FIGS. 1 and 2 there is fastened below a tilt-limiting disk 13 an air-filled hollow tire 34 which rests directly on the resting surface or the floor. The hollow tire 34 has a central connecting surface 38 in which a central recess 36 is formed for attachment of the hollow tire 34 to the support element or bar 8, as can be noted from FIG. 4. The hollow tire 34 serving as restoring device has the effect that the tilt-limiting disk which is deflected to the side elastically deforms the tire and provides a cushion which counteracts excessive tilt deflection. The recess 36 of hollow tire 34 is pushed over the bar 8 and fastened by a screw at the bottom.

Figure 5:
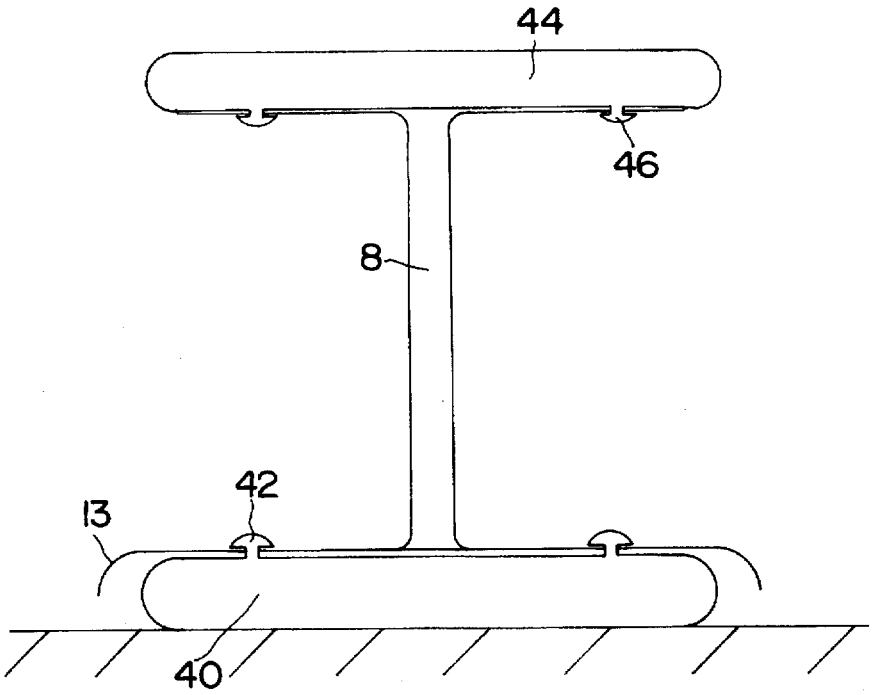
FIG. 5 is another embodiment, seen in cross section, in which the sitting surface and the floor-side surface are each formed by an elastic member.
Figure 6:
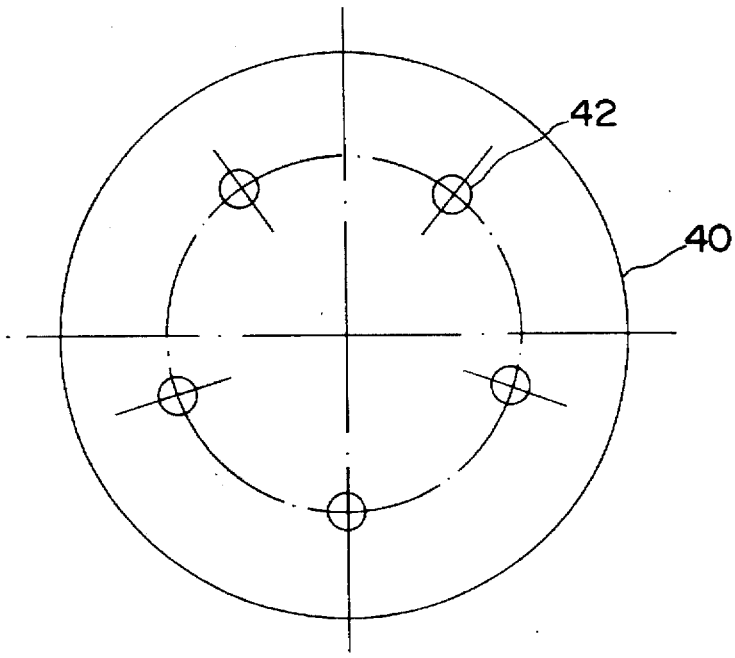
FIG. 6 is bottom view of FIG. 5.

FIG. 5 shows, in cross section, another embodiment of a sitting device of the invention in which an elastic body, namely an air-filled hollow body, is used in each case as sitting surface and as floor resting surface. On the upper sitting surface there is provided an air-filled hollow body 44 which serves as ball cushion, provided along its periphery with five engagement nipples 46 via which it engages in corresponding recesses in the seat-support plate. In this way the hollow body 44 can be removed, for instance for repair, replacement or cleaning. On the other hand, on the floor side, there is present an air-filled hollow body 40 also developed as cushion which has, along its periphery on the one side, engagement nipples 42 by which it can be fastened in corresponding recesses in a floor plate or tilt-limiting plate 13. As can be noted from FIG. 6, five recesses and five engagement nipples extend along the circumference of the floor plate or tilt-limiting plate 13 and thus create a reliable fastening of the hollow body to the lower bottom plate or tilt-limiting plate, in which connection the hollow body can be removed for cleaning, replacement or repair. The tilt-limiting disk 13 shown in FIG. 5 is similar to the disk shown in FIG. 3 and prevents excessive angular deflection of the sitting device.

I claim:

1. A sitting device having a first hollow body providing a sitting surface, a second hollow body, and an elongated seat support extending between said first and second hollow bodies, said first and second hollow bodies each respectively fully enclosing a volume of air, said seat support having opposing first and second ends, said first hollow body being mounted to said first end of said seat support such that said seat support supports said first hollow body, said second hollow body being secured to said second end of said seat support, wherein said second hollow body is elastically deformable to allow for tilting of the seat support and the sitting surface relative to the floor.

2. A sitting device according to claim 1, characterized by the fact that said first hollow body is elastically deformable, said first hollow body also being formed with a lower resting surface, the resting surface of which is attached to the seat support.

3. A sitting device according to claim 1, characterized by the fact that it is mounted on casters.

4. A sitting device according to claim 1, characterized by the fact that said second hollow body is annular shaped, whereby said annular shaped second hollow body urges the sitting device into a horizontal position.

5. A sitting device having an elastically deformable seat cushion formed with a upper sitting surface and a lower resting surface, a seat support, and an elastically deformable air-filled hollow support member, the seat support being attached to the resting surface of the seat cushion such that the seat cushion is supported by the seat support, the seat support being connected to the support member for tilted mounting of the seat cushion, the seat cushion and the support member being spaced apart, wherein the seat support includes a connecting element between the seat cushion and the support member, the connecting element being adjustable to vary the length thereof, and wherein the adjustment of the length of the connecting element varies the spacing between the seat cushion and the support member.

6. A sitting device having a sitting surface, a seat support supporting the sitting surface, and an elastically deformable air-filled hollow support member connected to the lower end of the seat support for tiltably mounting the sitting surface relative to a floor, wherein the seat support is formed with means for limiting the angle of tilt of the sitting surface relative to the floor.

7. A sitting device according to claim 6, characterized by the fact that the means for limiting the tilt are stop elements which cooperate with the floor, said elements protruding downwards beyond the lower end of the support member.

* * * * *